United States Patent [19]

Pollak, Jr. et al.

[11] Patent Number: 4,603,627

[45] Date of Patent: Aug. 5, 1986

[54] ROTARY SHUTTER DEVICE FOR A POSTAL MAILING SYSTEM

[75] Inventors: Philip Pollak, Jr., Westport; Keith E. Schubert, West Norwalk, both of Conn.

[73] Assignee: Pitney Bowes Inc., Stamford, Conn.

[21] Appl. No.: 592,680

[22] Filed: Mar. 23, 1984

[51] Int. Cl.[4] ..... B41L 47/46

[52] U.S. Cl. ..... 101/91; 101/45

[58] Field of Search ..... 19/91; 235/1 D, 101; 101/45, 91, 99, 110

[56] References Cited

U.S. PATENT DOCUMENTS

| | | | |
|---|---|---|---|
| 2,510,350 | 6/1950 | Rouan et al. | 101/91 |
| 3,823,666 | 7/1974 | Hanson | 101/91 |
| 4,287,825 | 9/1981 | Eckert, Jr. et al. | 101/91 |
| 4,331,075 | 5/1982 | Williams | 101/91 |
| 4,520,725 | 6/1985 | Haug | 101/91 |

*Primary Examiner*—Edgar S. Burr
*Assistant Examiner*—David A. Wiecking
*Attorney, Agent, or Firm*—Michael J. DeSha; Albert W. Scribner; William D. Soltow, Jr.

[57] ABSTRACT

A mailing system including a postage meter adaptable to either a high-speed mailing machine capable of parallel postal value selection or a low-speed mailing machine capable of serial value selection is disclosed. The postage meter includes a print drum with printing value members, a rod extends outwardly from the drum, the rod contains linear racks that are axially located above the horizontal center line of the rod, the linear racks interact with the value members to provide the proper value setting. Attached to the postage meter are a plurality of cross-over shafts with pinion gears, the pinion gears engage the racks to facilitate value selection. The postage meter also includes a rotary shutter device, the shutter device prevents unauthorized movement of the rack members and unintended rotation of the drum member. A cam bar arrangement within the postage meter interacts with the mailing machine to produce the above-mentioned actions.

8 Claims, 11 Drawing Figures

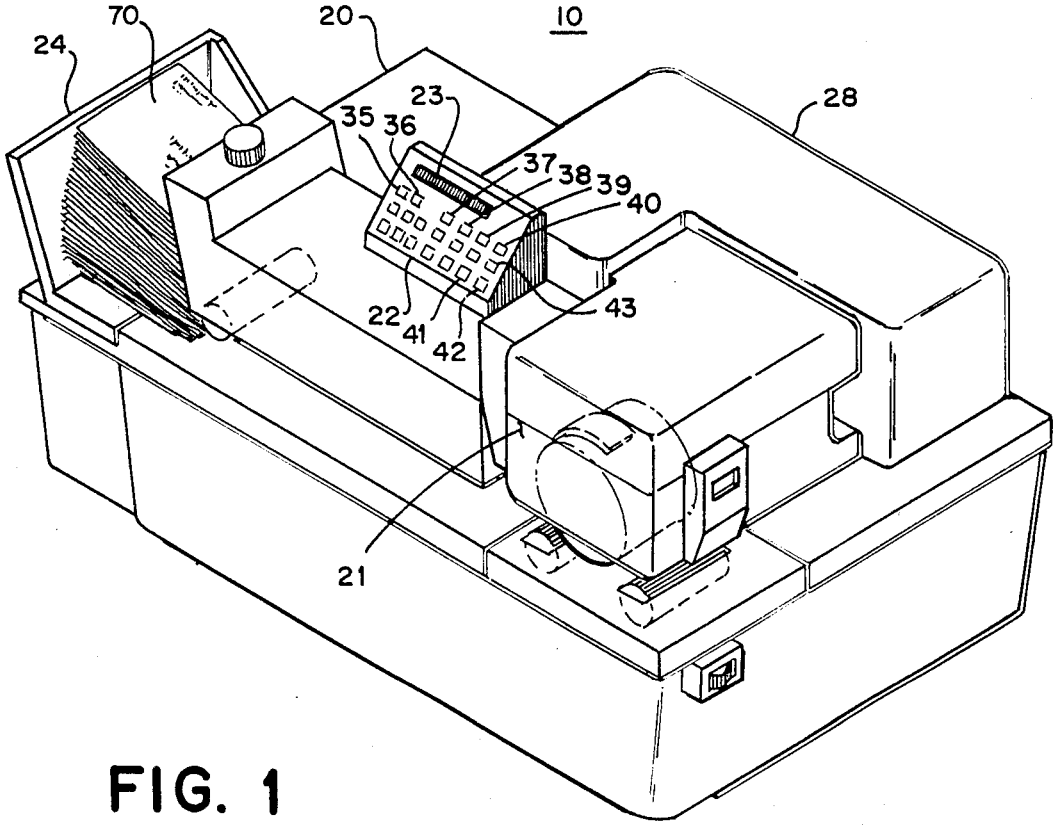
FIG. 1
FIG. 2
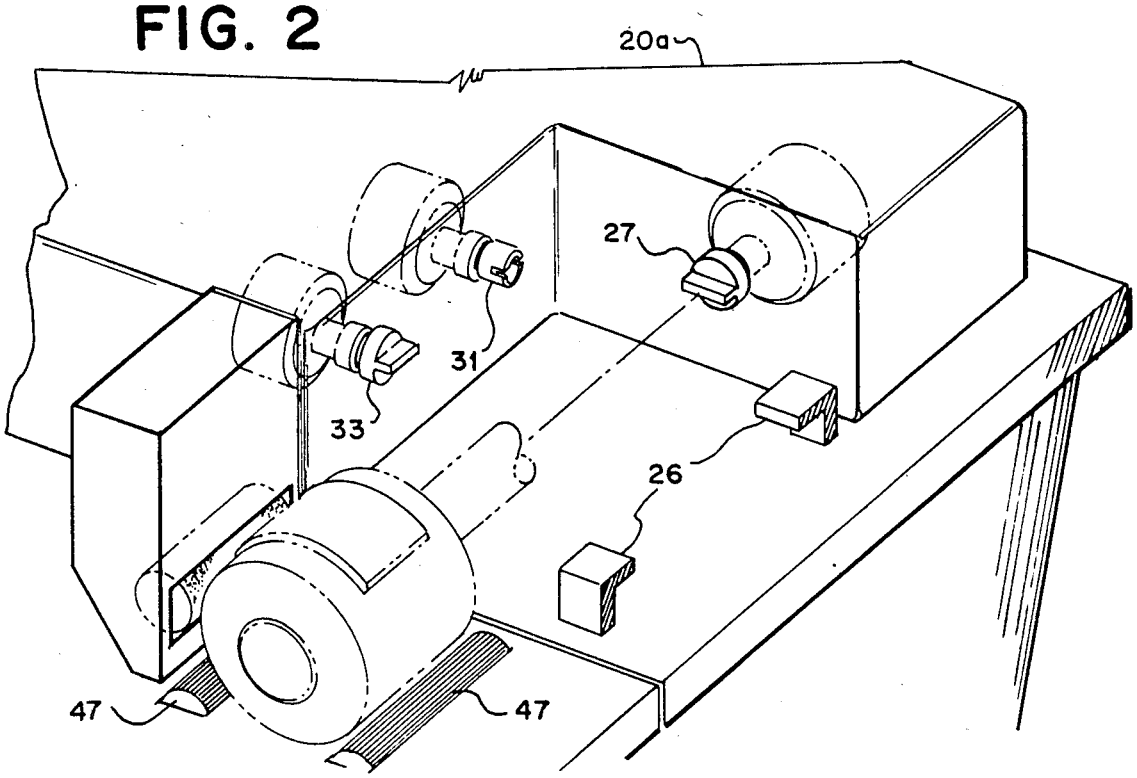

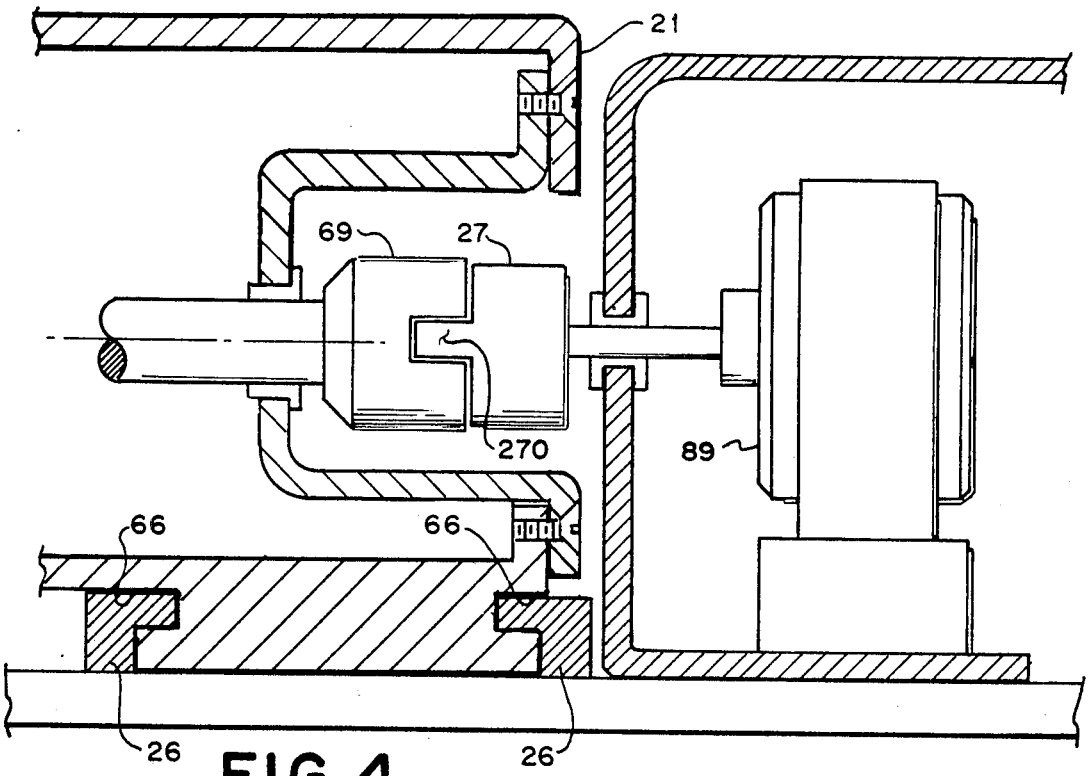
FIG. 4
FIG. 3
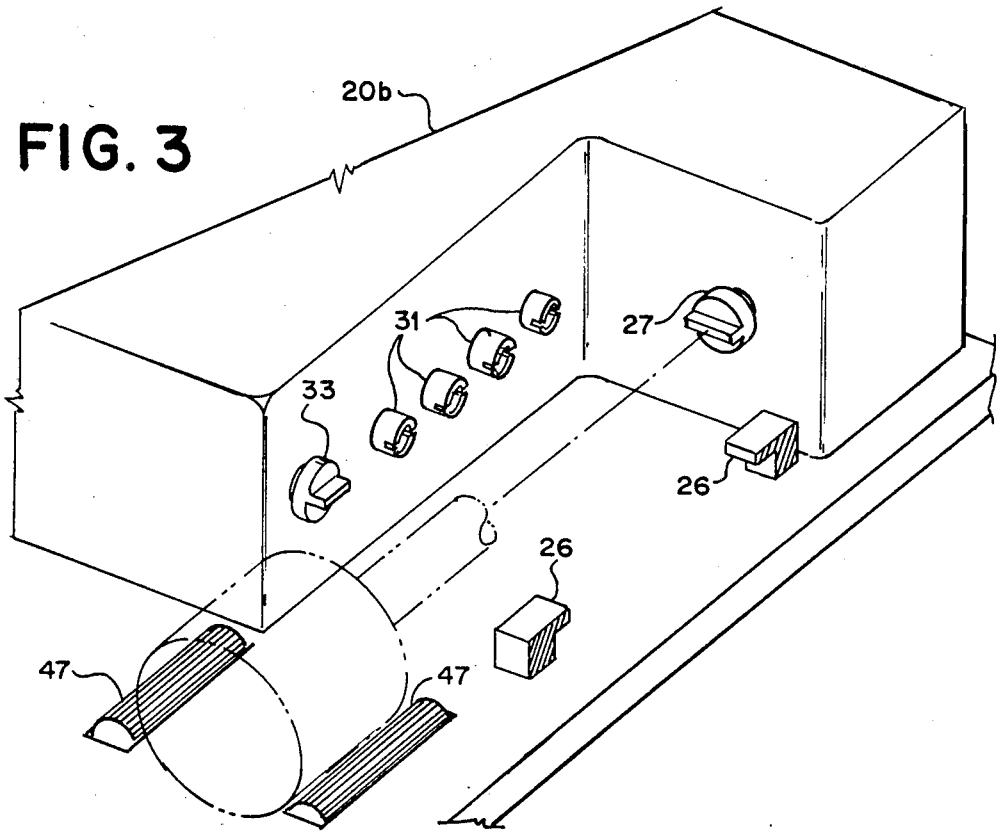

ROTARY SHUTTER DEVICE FOR A POSTAL MAILING SYSTEM

FIELD OF THE INVENTION

This invention relates to mailing systems and more particularly to a postage meter that will be adaptable to either a high-speed or low-speed mailing system.

CROSS REFERENCE TO RELATED APPLICATION

Reference is made to U.S. Pat. application Ser. No. 592,679 entitled A POSTAL MAILING SYSTEM HAVING AN ADAPTABLE POSTAGE METER, now abandoned and refiled on Nov. 7, 1985 as Ser. No. 798,343 concurrently filed herewith.

BACKGROUND OF THE INVENTION

Postage meters are devices for dispensing value in the form of postage printed on a mail piece such as an envelope. The term "postage meter" also includes other similar meters such as parcel post meters. A postage meter which is typically used is described in U.S. Pat. No. 4,301,507 issued on Nov. 17, 1981 in the name of John H. Soderberg, Alton B. Eckert and Robert B. McFiggans assigned to the assignee of this application. Meters of this type print and account for postage stored in the meter. Mechanisms are provided in the meter to set a particular value of postage to be printed on a mail piece.

Associated with postage meters are mailing machines. Mailing machines can typically be high-speed (that is, a system where the value selection function is done simultaneously) or, in the alternative, a mailing machine can be of the low-speed variety (that is, that each print wheel on a value selection drum of the postage meter is serially selected to allow for the printing of the postage stamp on the envelope or package). Typically, the low-speed machine is cheaper but does not handle mail as rapidly as the high-speed system.

Postage meters have been developed with electronic accounting systems which has led to the development of printing mechanisms and value setting mechanisms which cooperate with electronic systems in a manner to enhance the capability of the postage meter. Typically, a postage mailing system comprises a postage meter such as the before-mentioned Soderberg et al patent with appropriate electronic control circuitry and a mailing machine which conveys the envelopes along a path to a receptacle. Mailing systems have become highly automated and are capable of processing large numbers of envelopes at a high rate of speed. It is important therefore that a postage meter can be associated with a high-speed mailing machine or a low-speed mailing machine to allow for universal application.

Heretofore, the combination of the meter and mailing machine have been uniquely adapted; that is, a postage meter was configured in such a way that it was only suited to be mated to a particular mailing machine or a particular set of mailing machines. Thus, a high-speed mailing system was only suitable for use for a postage meter which had mating elements adapted thereto. Conversely, a low-speed mailing machine was suitable only to be connected to a postage meter that had mating elements adapted thereto. As is well known, a shutter bar is utilized in a typical mailing system to ensure that the postage meter values will not change and also prevent unauthorized rotation of the print drum. It is important that a shutter device be developed that can be adapted to the above-mentioned high-speed or low-speed mailing machines.

Therefore, it is clear that in a universal postage mailing system, that is, a system which will allow for a postage meter to be adaptable to a high-speed machine (parallel value selection) or a low-speed mailing (serial value selection) have a shutter device that can be adapted thereto. It is also important that the device be a simple alternative to that utilized in systems. It is also important that the device be a dependable one and be subject to only minimal adaptations.

SUMMARY OF THE INVENTION

The rotary shutter system of the present invention is particularly useful with a universal postage mailing system disclosed in aforementioned application entitled A POSTAL MAILING SYSTEM HAVING AN ADAPTABLE POSTAGE METER. The system is such that a postage meter can be attached to either a low-speed mailing machine capable of serial value selection or a high-speed mailing machine capable of parallel value selection.

In a first embodiment, the system comprises a mailing machine including apparatus to control the various movements of the postage meter for value selection. The mailing machine of this embodiment includes a plurality of drive members located at an outwardly facing side surface of the machine. The postage meter includes plurality of cross-over shafts with pinion gears on one end, a plurality of linear racks located within the same longitudinal plane and in mateable engagement with the other end of the shafts. The shafts engage the drive members of the mailing machine. The linear racks, in turn, extend into a drum member and are located along the axial length of a rod member. The rod member extends into the drum member and supports the racks. The other end of the racks mateably engage print wheel elements located within the drum member.

In response to signals from the apparatus in the mailing machine, the drive member shifts respective racks simultaneously. These racks, in turn, move the print wheel elements to correspond to the proper amount of postage value. This embodiment describes the high-speed mailing system with a postage meter adapted thereto.

In a second embodiment, the postage meter is utilized with a mailing machine that has only one drive member located on the outwardly facing side surface. As in the first embodiment, one shaft engages the drive member of the mailing machine. The drive member in response to the electromechanical apparatus in the mailing machine shifts a rack member. Thereafter, the mailing machine's apparatus causes the print drum to rotate and the next rack member is adjusted. The above action is repeated until all of the racks have adjusted the print wheels to their respective print values. Thus, in this embodiment, the postage meter has been adapted to a low-speed mailing machine.

In the second embodiment, a locking device located around the rod member can be utilized to allow for the adjustment of one rack member and at the same time prevent the inadvertent movement of any other rack member located within the rod member. This device comprises a planar section that surrounds the rod member. Within the planar section is a slotted opening that is one rack member wide.

A unique rotary shutter is disclosed. In Applicant's present invention, the rotary shutter allows for locking the print wheel values in place when printing is undertaken. The rotary shutter includes a shaft which interacts with a shutter drive member in the mailing machine. The shutter drive member in response to apparatus in the mailing machine rotates the shaft of the shutter to initiate the locking of print drum and/or racks in place. The shaft is attached to a cam surface which positions a first and second bar member away from each other. The bar members are positioned such that they surround the rod member of the postage meter. The first bar member has a semi-circular projection when in place prevents rotation of the print value member. The second bar member has a detent which when in place interacts with a flange projection of the rod member on the postage meter to prevent rotation of the drum.

The bar members are mateably connected to each other. Attached to each bar member are follower members which rest against the cam surface. As the cam surface rotates to a first position, the follower members are positioned such that the semi-circular projection on the first bar and the detent on the second bar, lock the racks and prevent the rod from rotating respectively. Correspondingly, when cam member is rotated to a second position, the racks are unlocked and the drum member is free to rotate. Thus, in this embodiment, in the first position the print wheel values cannot be changed and no printing can take place. In the second position, both actions can be undertaken.

Further, in accordance with the present invention, a rotary shutter is disclosed which members are identical to the first rotary shutter except that the configurations and interactions of the follower members and cam members are different. Thus, in this embodiment, when cam is rotated to a first position, the rod member is locked in place but the racks can be adjusted. Upon rotation of the cam to a second position, the rod member is unlocked and therefore can be rotated but the rack members are such that they cannot be adjusted. Thus, in this embodiment, the two positions allow one or the other of the actions to take place. These two rotary shutter devices in the alternative can prevent the unintended movement of the drum members and/or unauthorized movement of the rack member from their correct positions.

The rotary shutter systems of the present invention enables a single postage meter which reliably and properly operates and is to be adaptable to either high- or low-speed mailing machines. In so doing, a postage meter can be utilized which is simpler and more uniform than has heretofore been accomplished.

BRIEF DESCRIPTION OF THE DRAWINGS

FIG. 1 is a perspective view of a postal mailing system,

FIG. 2 is a perspective view of a cut-away portion of a low-speed mailing machine, FIG. 3 is a perspective view of a cut-away portion of a high-speed mailing machine, FIG. 4 is a cross-sectional view of the postage meter being attached to a mailing machine.

DETAILED DESCRIPTION

Figure 5:
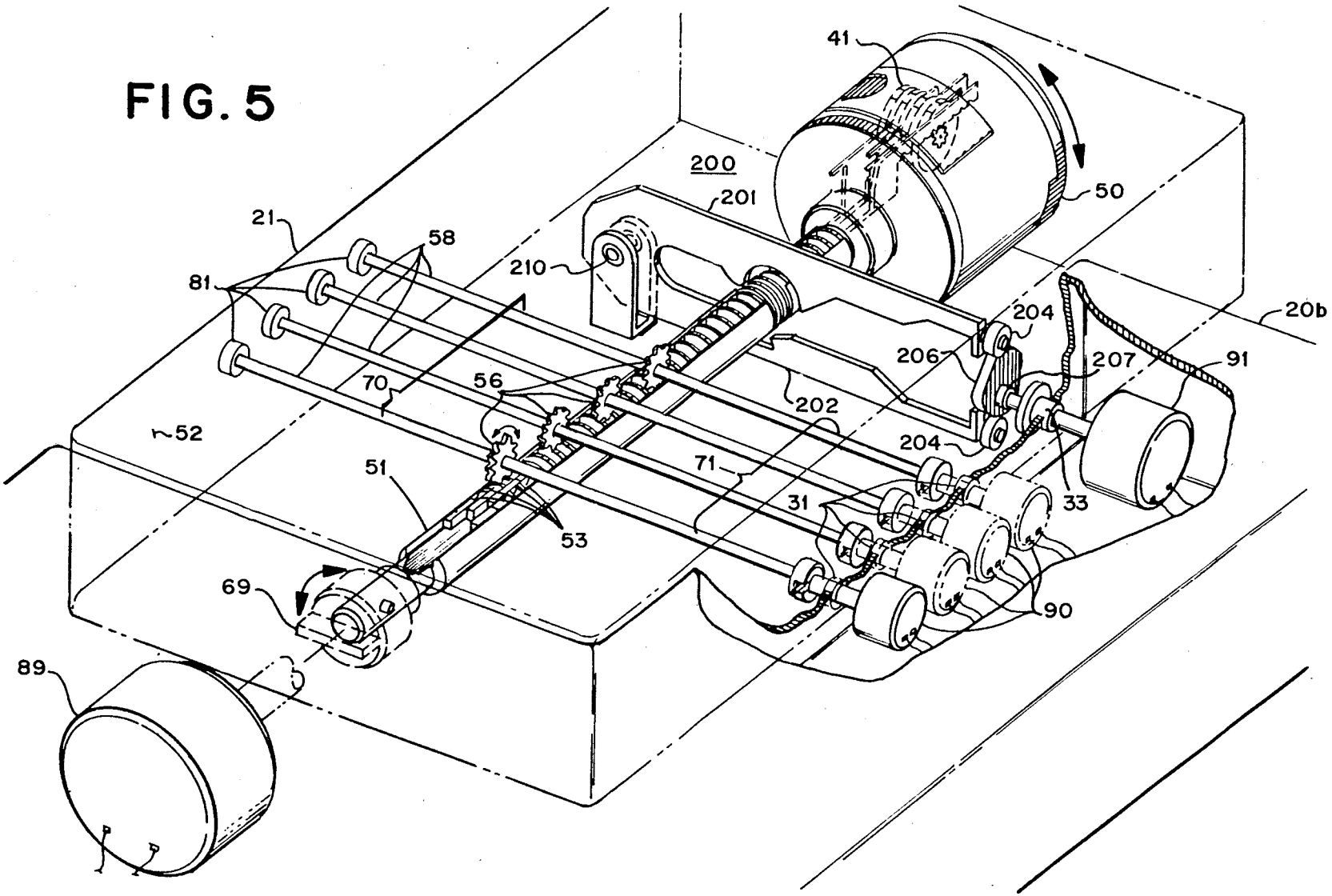
FIG. 5 is a cut-away view of the mailing machine of FIG. 3 attachably connected to a postage meter to form a high-speed mailing system.

FIG. 1 shows a perspective view of a mailing system 10. The mailing system 10 typically comprises the mailing machine 20 and a postage meter 21. The mailing machine 20 of this embodiment has a panel 22 at a top portion. The panel 22 contains a set of keys that can perform a variety of functions. The postage meter contains ascending and descending registers which perform their normal functions. Thus, the ascending register will give a running total of the printed postage and the descending register will inform an operator the amount of postage funds still remaining in the meter. Keys 35 and 36 can be utilized to display these amounts respectively on display 23 to allow the operator to monitor those respective values as well as perform other functions. Further, keys 37–40 may enable display in a conventional manner of other specific specialized values such as control or postage sum, piece count, batch count, batch value and batch count, respectively.

Also, the panel is provided with numeric setting keys 41 and a decimal key 42 operative therewith for setting the meter to print a desired amount of postage, the amount normally being displayed on the display 23. When the displayed amount has been set to the desired value, depression of a set postage key 43 effects the setting of postage meter's 21 apparatus. The mailing machine 20 also includes the feeder 24 for separating and feeding the envelopes 70 associated with the mailing machine. Electromechanical apparatus is located within enclosure 28 of the mailing machine 20 to operate the postage meter 21. Thus, in this system, there is apparatus or circuitry within the mailing machine 20 that would set the various operations of the postage meter 21. In the instant invention, the mailing machine 20 could be of the low-speed or high-speed variety depending upon the apparatus or circuitry located therein.

Looking at FIGS. 2 and 3, there are shown in cut-away view portions, the respective mailing machines 20*a* and 20*b* (high- and low-speed) with the postage meter 21 removed. As is readily apparent by viewing the two figures, each machine has as common elements latching members 26 and main gear 27. The latching members 26 cooperate to secure the postage meter 21 in its proper position on the mailing machine. As can be seen from cross-sectional view of FIG. 4, the body 25 of the postage meter 21 has slots 66 that will engage the latching members 26. In addition, in the rear of the postage meter 21 is slotted member 69 for engaging the projection 270 of master gear 27 when the postage meter 21 is properly positioned on the mailing machine. The main gear 27 through the slotted member 69 turns a print drum located within the postage meter 21 to imprint postage and/or move the drum 50 incremental distances. Also common to FIGS. 2 and 3, are rollers 47 for positioning the envelope (not shown) under the postage meter 21 (FIG. 1).

Finally, also common to the mailing machines 20*a* and 20*b* (FIGS. 2 and 3) are shutter drive members 33. The shutter drive members 33 provide the means for preventing unauthorized movement of the print values located within the postage meter 20. The shutter drive member 33 is also utilized to prevent unauthorized movement of the print drum of the postage meter.

A major difference between the mailing machines 20*a* and 20*b* in FIGS. 2 and 3 are in the number of drive members 31. As can be seen, the low-speed mailing machine 20*a* of FIG. 2 has only one of these drive members 31 while the high-speed mailing machine 20*b* of FIG. 3 has several; in this case, four of the drive members 31. Another difference between the mailing machines 20*a* and 20*b* is that in the mailing machine of FIG. 2, the various postal value digits are selected in a serial fashion while in the mailing machine of FIG. 3, the postal value digits are selected in a parallel or simultaneous fashion.

In the present invention, the same postage meter can be connected to either of the mailing machines 20*a* and 20*b* of FIGS. 2 and 3. Thus, what is disclosed is a mailing system that is universal. That is, the system allows for a postage meter which can be attached to a mailing machine which would provide simultaneous or parallel setting of the print values (high-speed) as in FIG. 3 and the meter can also be attached to a machine which provides a serial setting of the print values (low-speed) as in FIG. 2. The interaction of the postage meter with each of the mailing machines in FIGS. 2 and 3 will be shown in more detail by the remaining figures in association with the following discussion.

Associated with the interior of the mailing machines 20*a* and 20*b* are electromechanical means (not shown) for controlling the drive members 31. The electromechanical means can be stepper motors or the like which are extensively used and well known in the art. The controlling means will cause the drive members 31 to rotate in response to the signals produced by the panel 22 (FIG. 1) of the mailing machine. In addition, the main gear 27 of either mailing machine is also actuated by the controlling means for rotating a drum member of the postage meter as will be hereinafter described. As before discussed, this rotation of the drum member can either be for incremental movement of the drum member for value selection or full rotation to print the postal value on to an envelope located within the mailing machine.

Referring to FIG. 5, the postage meter 21 includes a drum member 50 with print wheel value members 41 located interior thereto. In this embodiment, there are four value members 41. These value members 41 would correspond to $99.99 thereby allowing for up to $100 of postage to be imprinted on an envelope. It is clear, however, that the number of print value members 41 is not limited to four for one ordinarily skilled in the art to practice our invention.

Also connected to the drum member 50 is circular rod member 51. Rod member 51 extends into the interior of drum member 50. The rod member 51 contains a plurality of rack members 53 which interact with the print value members 41 to provide a mechanism for rotating the value members 41.

As is seen from FIG. 5, the teeth of the rack member 53 engage the gears 56 of the respective value members 41 to provide for the movement of the value members 41. Rack members 53 extend axially along the entire length of the rod member 51. The rack members 53 of the present invention are all located in the same longitudinal plane. The rack members 53 are also located in a position above the horizontal center line of the rod member 51 to provide easy access thereto.

The other end of rod member 51 is connected to a receiving member 69 which engages the main gear 27 within the mailing machine. Attached across to the wall 52 of the postage meter 21 and across the rack members 53 are a plurality of cross over shaft gear assemblies 58. In this embodiment, there are four assemblies 58 to respectively engage the four rack members 53 located within the rod member 51.

The wall 52 has a set of openings 81 to accommodate a shaft portion 70 of the gear assemblies 58 such that the gear assemblies 58 can rotate freely at that end. The other end of each gear assembly 58 has a shaft member 71 that is adapted to be attached to the drive members 31 of the mailing machine 21. There is a pinion gear 56 also associated with each shaft that engages the rack members 53. The postage meter 21, by the configuration of the shaft gear assemblies 58 allows for adaptation of the meter to either a high-speed or low-speed mailing machine.

The following discussion will describe how the postage meter 21 is utilized with first, a high-speed mailing machine 20*a* and then second, with a low-speed mailing machine 20*b* to show a universal mailing system. FIG. 5 depicts a cut-away view of the postage meter attached to a high-speed mailing machine 20*b*. As can be seen in FIG. 5, the drive members 30 of the high-speed mailing machine engage all four of the gear assemblies 58 of the postage meter 21. When the keyboard 22 (FIG. 1) of the mailing machine 20*b* sets the postal value to be imprinted, the drive members 31 rotate the shafts 58 such that the rack members 53 rotate the print wheel value members 41 to their proper positions. In the high-speed mailing machine 20*b*, this activity is done in a parallel or simultaneous fashion thereby facilitating a more rapid setting of the value members 41.

The electromechanical apparatus within the mailing machine 20 may be stepper motors 90 to perform the parallel movement of the rack members 53 by the gear assemblies 58. Thereafter, the mailing machine 20*b* will actuate the main gear 27 through motor 89 to rotate the drum member to place its imprint of that print value on the envelope (not shown) being conveyed across the rollers 47 (FIG. 1).

Figure 6:
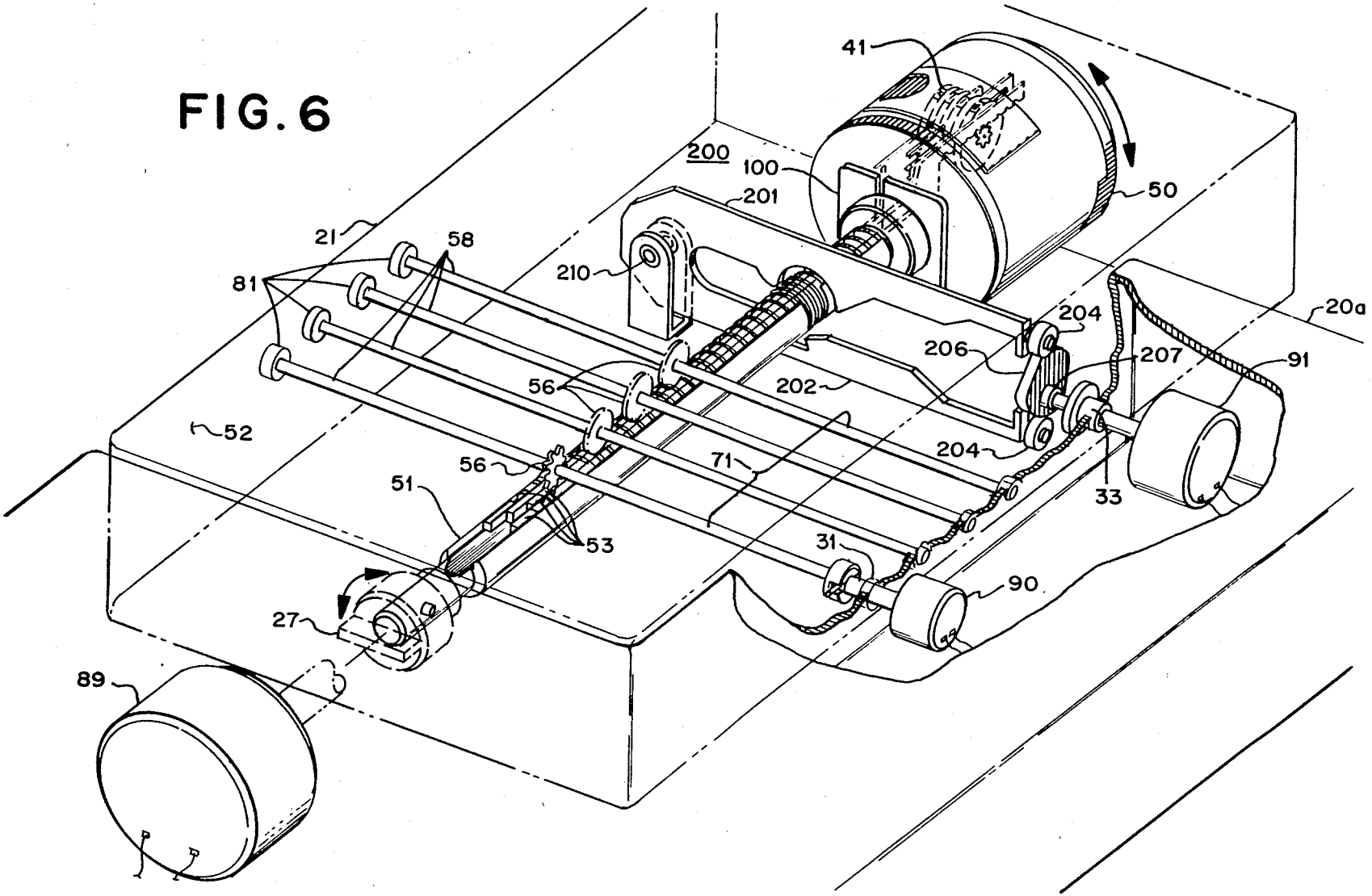
FIG. 6 is a cut-away view of the mailing machine of FIG. 2 attachably connected to the postage meter of FIG. 4 to form a low-speed mailing system.

Referring to FIG. 6, a cut-away view perspective, the same postage meter is attached to a mailing machine 20*a* with only one drive member 31 (i.e., the low-speed mailing machine). In this embodiment, the drive member 31 engages one gear assembly 58 preferably the assembly closest to the drive member 31 as shown in the figure. In this manner, the drum 50 only has to rotate in one direction to facilitate value selection.

When the keyboard 23 (FIG. 1) sets the postal value to be applied to the envelope, the drive member 31 adjusts the first print value member 58 and the electromechanical apparatus within the mailing machine 20*a*, in this case, one stepper motor 89, causes the main gear 27 to rotate the drum member one incremental space to the next adjacent rack member 53. The drive member 31 then adjusts that rack member 53 to the proper print wheel value and so on and so forth until all four rack members 53 are adjusted until the value members 41 reach their proper values. After these adjustments are made, the stepper motor 89 within the mailing machine 20*a* causes the main gear 27 to rotate the drum member 50 over an envelope (not shown) to print the postal values thereon. In the low-speed mailing machine 20*a*, therefore, there is serial adjustment of each rack member 53. This adjustment would be slower then the adjustment made with a high-speed mailing machine 20*b* of FIG. 4 because, as before described, the high-speed mailing machine 20*b* adjusts the rack members 53 simultaneously.

Figure 7:
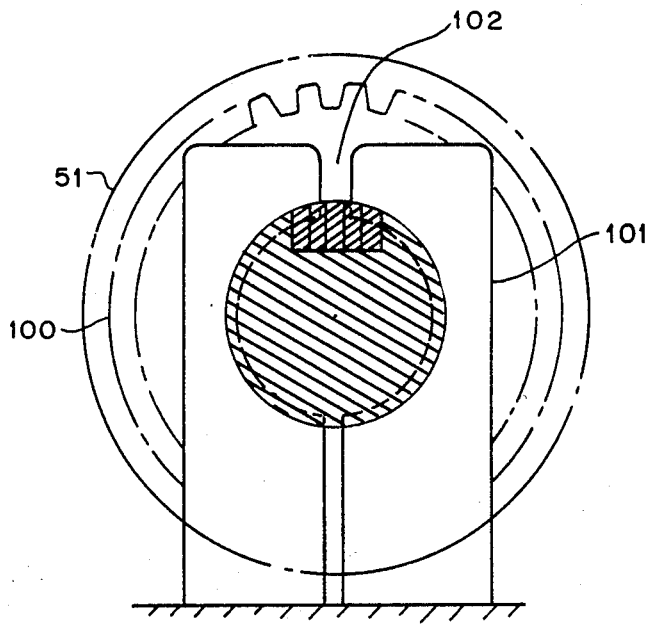
FIG. 7 is a cross-sectional view of a locking device utilized in connection with the mailing system of FIG. 6.

During serial selection, the rack member 53 adjacent to one that is being adjusted can be inadvertently pulled along when the adjusted rack member 53 moves to its final position. This can cause problems in that incorrect postal value setting may result through this inadvertent movement. As a further refinement of Applicant's invention for use with the mailing machine 20*a* of FIG. 6, there is a locking device 100 advantageously placed around the rod member 51 of the postage meter 21. The locking device 100 is stationary with respect to the drum member 50 to lock out all but the rack member 53 that is being adjusted. The locking device 100 shown in cross-sectional view in FIG. 7 comprises a planar member 101 which surrounds the rack members 53 whereby a slotted opening 102 that is one rack member 53 wide is shown therein. This slotted opening 102 will allow one rack member 53 to move and prevent other rack members 53 from moving. The locking device 100 as hereinabove described, prevents in a serial selection system the inadvertent movement of adjacent rack members 53 when one is being adjusted.

A feature common to the mailing system of FIGS. 5 and 6 are the rotary shutter member 200. A shutter bar arrangement is used typically in most mailing machines to prevent unintended tampering of the mailing machines. The shutter member 200 is similarly utilized in this system to prevent unauthorized movement of the drum 50 and also to prevent unauthorized adjustment of the rack members 53 while the postage meter is in place on the mailing machine.

The shutter member 200 comprises a first and second bar members 201 and 202. Bar members 201 and 202 surround rod members 51 and are attachably connected at one end to each other by pin 210. The pin is attached to a hinge 203 which, in turn, is attached to the housing of postage meter 21. The other ends of the bar members 201 and 202 have follower members 204 which ride on a cam 206. The cam 206 has a shaft 207 which is adapted to be attached to shutter drive member 33 of the mailing machine. The shutter drive member 33, in turn, is actuated by stepper motor 91.

Figure 8:
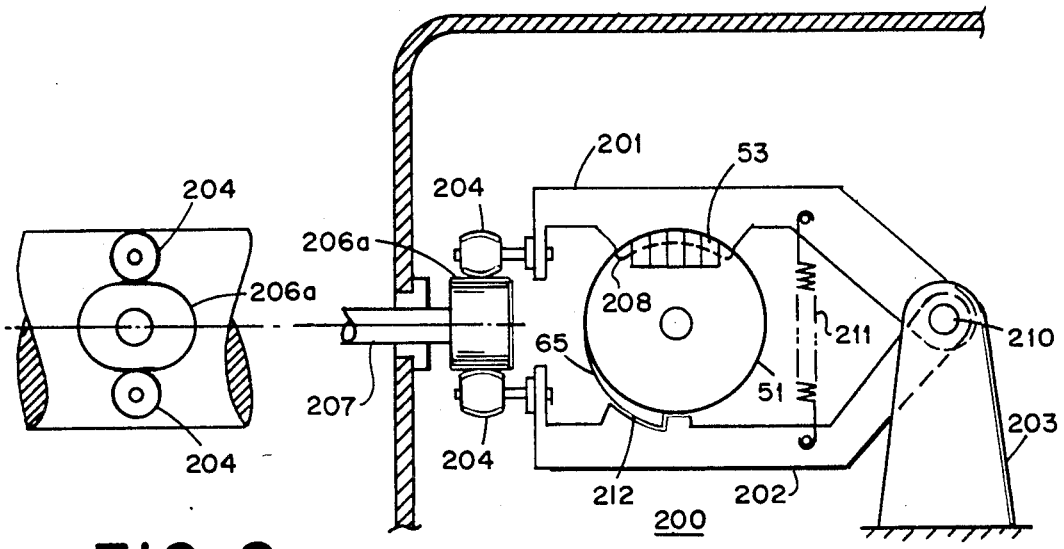
FIG. 8 is a cross-sectional view of a first embodiment of a rotary shutter bar.

FIG. 8 shows in a cross-sectional, cut-away view, one embodiment of shutter member 200. As is seen in the figure, oblong cam 206*a* is rotated in a position such that the follower members are located at a point closest to each other. The spring 211 causes tension upon the bar members 201 and 202 to keep them biased together. Bar member 201 has a semi-circular flange 208 to lock the rack members 53 in place. Bar member 202 has a detent 212 that engages a fin-like flange 65 located on rod member 51. Thus, in this position, the rack members 53 are locked in place and the drum member 50 is prevented from rotating.

Figure 9:
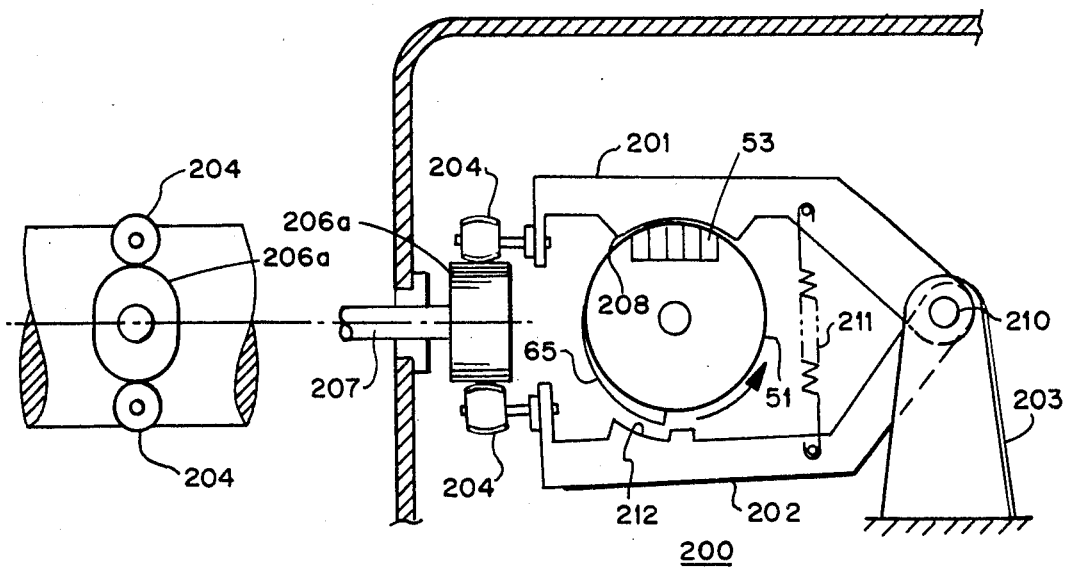
FIG. 9 is the same view as FIG. 8 with the shutter being rotated to a second position.

When the gear 27 (FIGS. 4 and 5) and therefore the cam 206*a* is rotated as shown in FIG. 9 to a second position, the follower members 204 are spread apart by the cam 206 so that the rack members 53 are unlocked by flange 208 and the flange 65 is disengaged from detent 212. Thus, in this position, the rack members 53 can be adjusted and the drum 50 can be rotated.

Therefore, in this embodiment, when the main gear 27 is in a first position, no movement can take place. When the gear 27 is moved by a stepper motor or the like to a second position both drum rotation and rack movement can take place.

Figure 10:
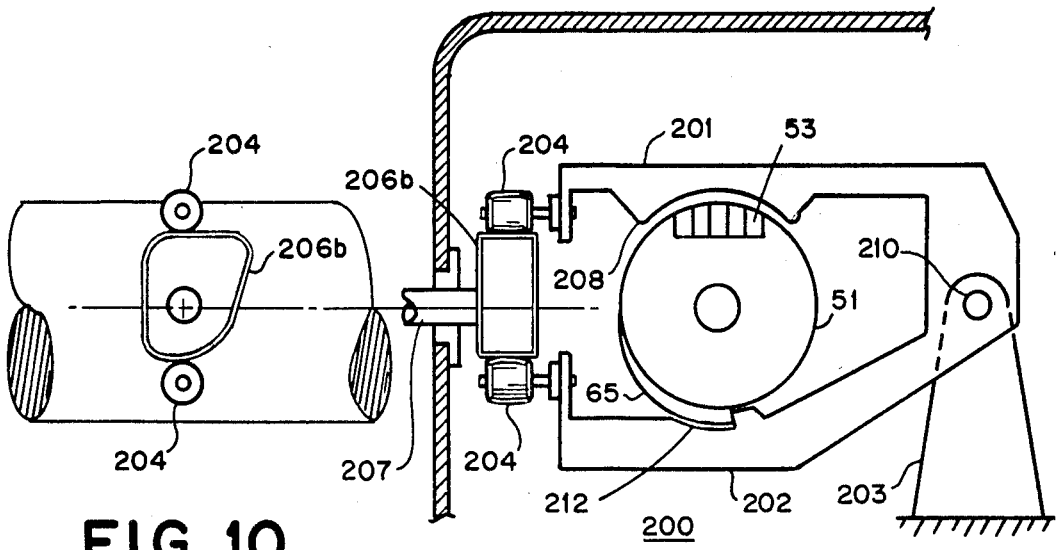
FIG. 10 is a cross-sectional view of a second embodiment of a rotary shutter in a first position.
Figure 11:
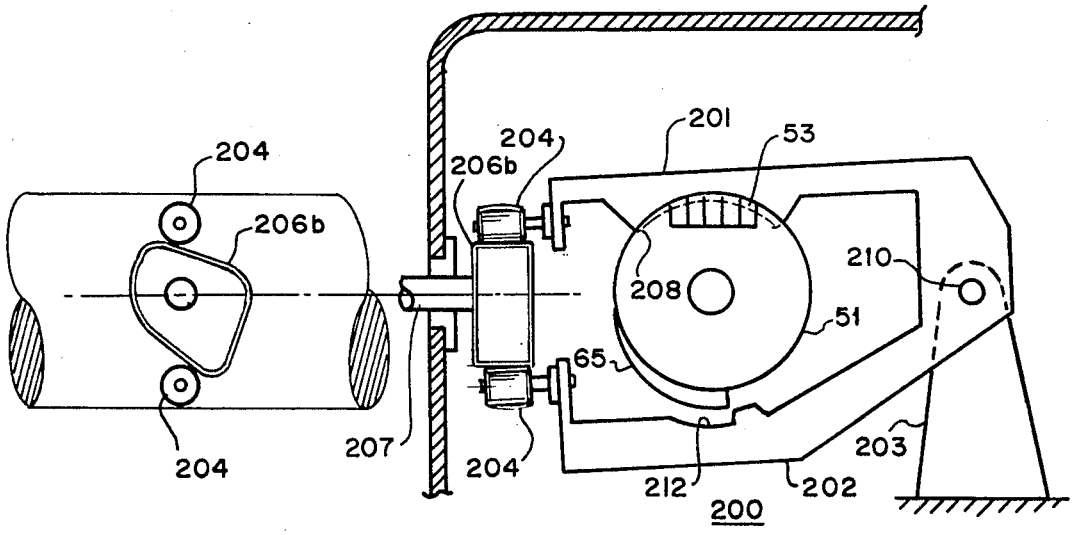
FIG. 11 is the same view as FIG. 10 with the shutter being rotated to a second position.

A second embodiment of a rotary shutter member 200 is shown in FIGS. 10 and 11. The members that comprise this shutter member 200 are virtually identical to that of FIGS. 8 and 9, with two exceptions: (1) the spring 211 is not used and (2) the cam member 206*b* is of an irregular configuration. Thus, as can be seen by referring to FIG. 10, when the irregularly shaped cam 206*b* is in a first position, the rack members are unlocked but the rod member can't rotate because of the engagement of the flange 65 with the bar member. When the irregularly shaped cam 206*b* is rotated by the shutter drive member (FIG. 5) to the position as shown in FIG. 11, the rack members 53 are locked in place but the drum member 50 can be rotated because the flange 65 is no longer held by the detent 212 of bar member 202.

Thus, in this embodiment, the shutter member 200 in each of the two positions would allow one or the other of the actions to occur. That is, in the first position, the rack members 53 can be adjusted and in the second position, only the drum member 50 can be rotated.

It is clear that either of these embodiments of rotary shutter member 200 could be utilized in the postage meters 21 that have been before described to prevent unauthorized movement of the drum member 50 and rack members 53.

It is known and understood that the term postage meter, as used herein, refers to the general definition of a device for the imprinting of a defined unit value for governmental or private carrier parcel, envelope or package delivery, or other like application for unit value printing. Thus, although the term postage meter is utilized, it is both known and employed in the trade as a general term for devices utilized in conjunction with services other than those exclusively employed by governmental postal services. For example, private parcel or freight services purchase and employ postage meters as a means to provide unit value pricing for individual parcels, including accounting and printing functions.

The above-described examples of mailing systems can be modified in a variety of ways and those modifications would still be within the spirit and scope of Applicants' invention. For example, the number of drive members and gear and shaft assemblies could be of any number and should not be limited to the specific number utilized to describe the invention. Thus, while this invention has been disclosed by means of specific illustrative embodiments, the principles thereof are capable of a wide range of modification by those skilled in the art within the scope of the following claims.

What is claimed is:

1. A postage meter to be adapted to a mailing machine to form a mailing system, said mailing machine including a driving member, the meter having a housing, the meter including a rotatable drum member, a rod member extending outwardly from the drum member, the rod member having a plurality of moveable racks located axially therein, the improvement comprising a rotary shutter device, the rotary shutter device being connected to the housing of the meter, the rotary shutter device comprising: locking means substantially surrounding the rod member, the locking means further comprising a first bar member which is in mateable engagement with the racks of the postage meter, a second bar member which attachably connected to the first bar member and in mateable engagement with the rod member of the postage meter, the first bar member being in a position above the second bar member, means for biasing the first and second bar members, and a cam member, the cam member being in mateable engagement with the first and second bar members, and a shaft member which is connected to the cam member and is also adapted to engage the driving member of the mailing machine, the locking means in a first position preventing the rod member from rotating and in a second position preventing the racks from being moved.

2. The rotary shutter device of claim 1 in which the biasing means is a spring member.

3. In a postage meter which is adaptably connected to a mailing machine, the mailing machine including a driving member, the postage meter having a rod member, the rod member having axially aligned racks therein, the postage meter inclucing a locking means substantially surrounding the rod member, the locking means comprising:

a first bar member attachably connected to the postage meter, a second bar member in a postion below the first bar member and connected to the first bar member, a cam member which is mateably engaged to the first and second bar members, and a shaft member which is connected to the cam member and is also adapted to engage the driving member of the mailing machine, the locking means in response to the movement of the driving member of the mailing machine locking the racks in place and preventing the rod member from rotating.

4. In a postal mailing system which includes a postage meter including a housing adapted to a mailing machine, the mailing machine having a drive member, the postage meter having a rod member, the rod member having axially aligned racks therein, the racks being in the same longitudinal plane, the rod member also having a flange member connected thereon, an improvement of the postage meter comprising a shaft member which is attachably connected to the drive member, a cam member which is attached to the shaft member at an end away from the drive member, means mateably connected to the cam member for locking the racks in place and also for the locking the rod member in place, the mateably connected means for preventing movement of the racks and for preventing rotation of the rod member, the mateably connected means comprising a first bar member and a second bar member being attached to and in a postion below the first bar member, the first and second bar members substantially surrounding the rod member of the meter and the second bar member being mateably engaged with the flange member.

5. The improvement of claim 4 in which the first bar member has means comprising a semicircular projection which engages the racks for preventing their movement, and the second bar member has means comprising a detent for engaging the flange member for preventing the rotation of the rod member.

6. In a postage mailing system including a postage meter adaptably connected to a mailing machine, the mailing machine including:

means for controling the postage meter, the mailing machine also having a driving means located on an outer surface thereof, the postage meter including:

a plurality of gear assembly members, each of the plurality of assembly members comprising a shaft, and a gear located on the shaft, each of the shafts of the assembly members mateably engaging the driving means for rotation, a print drum member with a rod member extending therefrom, the print drum member also having a flange extending therefrom, the rod member having a plurality of print value members located therein, a plurality of linear racks located axially within the rod member, the racks being located in the same longitudinal plane, the racks also being engaged with the print value members of the postage meter, the gears of the assembly member being adaptably engaged with the racks, an improvement comprising:

a shaft member which is attachably connected to the driving means, and first and second bar members, the first bar member being a position above the second bar member, the first bar member having a semicircular projection which prevents movement of the rack members and the second bar member having a detent which when in engagement with the flange prevents rotation of the rod member, the first and second bar members being position such that the rod member of the postage meter is substantially surrounded.

7. A postage mailing system including a postage meter adaptably connected to a mailing machine, the mailing machine including:

means for controlling the postage meter, the mailing machine also having a first and second driving means located on an outer surface thereof, the postage meter including:

a plurality of gear assembly members, each assembly member having a shaft connected thereto and a gear mounted thereon, each of the shafts being mateably engaged to the first driving means for rotation, a drum member with a rod member extending therefrom, the drum member also having a plurality of print value members located therein, the rod member having a flange connected thereto, a plurality of moveable linear racks located axially within the rod member, the racks being located in the same longitudinal plane, the gears of the assembly members being in adaptable engagement with the racks, the racks each also being engaged with the print value member of the postage meter, the first driving means in response to the controlling means rotating the shaft members to select the proper print values, the controlling means also for causing the drum member to facilitate engagement of each rack member with each gear in a serial fashion during value selection, the controlling means also rotating to facilitate printing the postage value, and a device for preventing the inadvertent movement of the racks and rod member;

the preventing device further comprising:

a cam member attachably connected to the second driving means, a first bar member which comprises means for preventing movement of the racks, and a second bar member connected to the first bar member, said second bar member comprising means for preventing rotation of the rod member, and the first and second bar members mateably engaging the cam member, the first bar member being in a position substantially above the second bar member, the first and second bar members substantially surrounding the rod member, the first bar member having a semicircular projection and the second bar member having a detent, the cam member in response to the second driving means being rotated to a first position to move the projection of the first bar member into engagement with the rack members to prevent movement thereof and also to move the detent of the second bar member to engage the flange of the rod member to prevent rotation thereof, and the cam member in response to the second driving means being rotated to a second position to engage the first and second bar members to allow for movement of the rack members and rotation of the rod member respectively.

8. A postage mailing system including a postage meter adaptably connected to a mailing machine, the mailing machine including:

means for controlling the postage meter, the mailing machine also having a first and second driving means located on an outer surface thereof, the postage meter including:

a plurality of gear assembly members, the assembly members having a plurality of shafts, each of the shafts having a gear mounted thereon, each of the shafts also being mateably engaged to the first driving means for rotation, a drum member with a rod member extending therefrom, the drum member also having a plurality of print value members located therein, the rod member having a flange connected thereto, a plurality of moveable linear racks located axially within the rod member, the racks being located in the same longitudinal plane, the gears of the assembly members being in adaptable engagement with the racks, the racks also being engaged with the print value member of the postage meter, the first driving means in response to the controlling means rotating the shaft members to select the proper print values, the controlling means also for causing the drum member to facilitate engagement of each of the plurality of racks in a serial fashion with each gear during value selection, the controlling means also rotating to facilitate printing the postage value, and a device for preventing the inadvertent movement of the racks and rod member the preventing device further comprising:

a cam member attachably connected to the second drive means, a first bar member which comprises means for preventing movement of the racks, and a second bar connected to the first bar member, said second bar member comprising means for preventing rotation of the rod member, the first and second bar members being mateably engaged to the cam member, the first bar member being in a positon substantially above the second bar member, the first and second bar members substantially surrounding the rod member, the first bar member having a semicircular projection and the second bar member having a detent, the cam member in response to the second driving means being rotated to a first position to move the projection of the first bar member out of engagement with the racks to allow for movement thereof and also to move the detent of the second bar member to engage the flange of the rod member to prevent rotation thereof and the cam member to prevent rotation thereof and the cam member in response to the second driving means being rotated to a second positon to move the projection of the first bar member into engagement with the racks to prevent movement thereof and to disengage the second bar member to allow for rotation of the rod member.

* * * * *